US012410611B2

(12) United States Patent
Applegate et al.

(10) Patent No.: US 12,410,611 B2
(45) Date of Patent: Sep. 9, 2025

(54) PRE-ASSEMBLED INTERNAL FRAME FOR MODULAR WALL SECTION

(71) Applicant: FELLOWES, INC., Itasca, IL (US)

(72) Inventors: Shawn M. Applegate, Streamwood, IL (US); Michael Egan, Chicago, IL (US); James Edward Losser, St. Charles, IL (US); Tai Hoon K Matlin, Round Lake Beach, IL (US)

(73) Assignee: FELLOWES, INC., Itasca, NY (US)

( * ) Notice: Subject to any disclaimer, the term of this patent is extended or adjusted under 35 U.S.C. 154(b) by 278 days.

(21) Appl. No.: 18/129,681

(22) Filed: Mar. 31, 2023

(65) Prior Publication Data

US 2023/0313527 A1 Oct. 5, 2023

Related U.S. Application Data

(60) Provisional application No. 63/327,389, filed on Apr. 5, 2022.

(51) Int. Cl.
*E04B 2/74* (2006.01)

(52) U.S. Cl.
CPC ..... *E04B 2/7437* (2013.01); *E04B 2/7425* (2013.01); *E04B 2002/7466* (2013.01)

(58) Field of Classification Search
CPC .... E04B 2/7407; E04B 2/7422; E04B 2/7425; E04B 2/7433; E04B 2/7437; E04B 2/76;
(Continued)

(56) References Cited

U.S. PATENT DOCUMENTS 3,221,453 A * 12/1965 Lietaert ..... E04B 2/965 52/235
3,312,032 A * 4/1967 Ames ..... E04B 2/78 52/481.1

(Continued)

FOREIGN PATENT DOCUMENTS

CA 2225157 A1 6/1999
CA 2516083 C 3/2013

(Continued)

OTHER PUBLICATIONS

International Preliminary Report on Patentability issued in International Application No. PCT/US2023/016648, dated Oct. 17, 2024.

(Continued)

*Primary Examiner* — James M Ference
(74) *Attorney, Agent, or Firm* — Pillsbury Winthrop Shaw Pittman, LLP

(57) ABSTRACT

A pre-assembled internal frame for a modular wall comprises a pair of vertical frame members. Each first flange of the vertical frame member has a pair of series of vertically arranged mounting openings, and each second flange has a single series. The vertical frame members are oriented to enable the frame to be arranged in an end to end junction with another frame with adjacent vertical frame members thereof abutting. This provides three of the series of vertically arranged openings on each side of the modular wall at the end to end junction. A fastener is positioned in a fastener receiving portion for fastening the horizontal frame member to the vertical frame members. The fastener receiving portions are recessed laterally inwardly from the first and second web sections for avoiding interference between adjacent fasteners when the frame is arranged in the end to end junction with another such frame.

30 Claims, 10 Drawing Sheets

(58) Field of Classification Search
CPC ..... E04B 2/764; E04B 2/78; E04B 2/7836; E04B 2/7854; E04B 2/7872; E04B 2/789; E04B 2002/7466; E04B 2002/7483; E04B 2002/7487
USPC ..... 52/36.6, 239, 653.1, 745.1
See application file for complete search history.

(56) References Cited

U.S. PATENT DOCUMENTS 3,694,975 A * 10/1972 Pollock ..... E04B 2/78 52/36.6
3,788,378 A * 1/1974 Sobel ..... E04B 2/7427 160/229.1
3,789,561 A * 2/1974 Herbert ..... E06B 3/988 403/258
3,789,567 A * 2/1974 Rae ..... F16B 5/0012 52/584.1
3,882,652 A * 5/1975 Marchello ..... E04B 2/7854 52/127.6
4,631,881 A * 12/1986 Charman ..... H02G 3/288 174/495
4,852,317 A * 8/1989 Schiavello ..... E04B 2/7424 52/239
4,862,659 A * 9/1989 Wilson ..... E04F 17/08 174/67
5,058,347 A * 10/1991 Schuelke ..... E04B 2/7425 52/584.1
5,117,599 A * 6/1992 Voss ..... E04B 2/7425 52/239
5,129,200 A * 7/1992 Kaneko ..... A47B 83/001 52/239
5,209,035 A * 5/1993 Hodges ..... E04B 2/7425 52/239
5,219,406 A * 6/1993 Raz ..... E04B 2/7425 403/252
5,321,579 A * 6/1994 Brown ..... E04B 2/7416 52/36.5
5,491,943 A * 2/1996 Vondrejs ..... E04B 2/7425 52/36.6
5,625,991 A * 5/1997 Sturrus ..... E04B 2/7425 52/584.1
5,664,380 A * 9/1997 Hsueh ..... E04B 2/7437 211/184
5,997,117 A * 12/1999 Krietzman ..... H02B 1/301 403/219
6,000,179 A * 12/1999 Musculus ..... E04B 2/7425 403/231
6,112,485 A 9/2000 Beyer et al.
6,115,977 A * 9/2000 Hornberger ..... E04B 2/7433 52/762
6,216,398 B1 * 4/2001 Shipman ..... E04B 2/7453 108/50.01
6,425,219 B1 * 7/2002 Barmak ..... E04B 2/7425 52/656.1
6,601,349 B1 * 8/2003 Corden ..... E04B 2/7453 52/36.5
6,637,167 B2 10/2003 Hanna
6,718,717 B2 4/2004 Henderson et al.
6,775,953 B2 * 8/2004 Burken ..... E04B 2/7425 52/489.1
6,883,277 B2 * 4/2005 Wiechecki ..... E04B 2/745 52/36.5
7,185,460 B2 * 3/2007 Corden ..... E04B 2/7453 52/36.5
7,418,805 B2 * 9/2008 Tan ..... E04B 2/7425 52/234
7,434,364 B2 * 10/2008 MacDermott ..... E06B 1/366 52/584.1
7,487,622 B2 2/2009 Wang
7,603,821 B2 * 10/2009 Eberlein ..... E04B 2/7425 52/261
8,176,695 B2 5/2012 Deweerd et al.
8,656,648 B2 * 2/2014 Liegeois ..... E04B 2/7425 52/36.6
9,249,567 B2 2/2016 Yu et al.
9,650,785 B2 5/2017 Yu et al.
9,803,361 B2 10/2017 Von Hoyningen Huene et al.
9,850,657 B2 * 12/2017 Fink ..... E04B 2/7412
RE47,693 E 11/2019 Gosling et al.
10,689,845 B1 * 6/2020 Bilge ..... E04B 2/723
10,941,605 B2 3/2021 Warren et al.
11,391,033 B2 7/2022 Gosling
2003/0154673 A1 * 8/2003 MacGregor ..... F16M 11/041 52/239
2003/0173472 A1 * 9/2003 Liu ..... E04B 2/7433 403/217
2006/0000187 A1 * 1/2006 Hager ..... E04B 2/7422 52/800.1
2008/0104895 A1 * 5/2008 Deweerd ..... E04B 2/7425 52/79.9
2008/0104907 A1 * 5/2008 Glick ..... E04B 2/7425 52/239
2010/0307080 A1 * 12/2010 Parshad ..... E04B 2/7425 52/239
2014/0208673 A1 * 7/2014 Huang ..... E04B 2/7425 52/234
2020/0318339 A1 * 10/2020 Friedlos ..... E04B 2/7437
2022/0154451 A1 * 5/2022 Marshall ..... E04B 1/5818
2023/0313527 A1 * 10/2023 Applegate ..... E04B 2/7425 52/745.1
2023/0323662 A1 * 10/2023 Egan ..... E04B 2/7407 52/241
2023/0358036 A1 * 11/2023 Losser ..... E04B 2/789
2023/0392372 A1 * 12/2023 Matlin ..... E04B 2/02
2024/0360666 A1 * 10/2024 Egan ..... E04B 2/7422
2024/0417973 A1 * 12/2024 Matlin ..... A47B 57/408

FOREIGN PATENT DOCUMENTS

CN 204983241 U 1/2016
CN 211121168 U 7/2020
DE 3825566 A1 2/1990
DE 37 26 255 C2 3/1994
DE 102016103386 A1 9/2016
EP 0 200 514 A1 11/1986
EP 1094167 A2 10/2000
FR 2878239 A1 5/2006
WO 98/35110 A1 8/1998

OTHER PUBLICATIONS

International Search Report and Written Opinion issued in International Application No. PCT/US2023/016648, dated Jul. 10, 2023.

* cited by examiner

PRE-ASSEMBLED INTERNAL FRAME FOR MODULAR WALL SECTION

CROSS-REFERENCE TO RELATED APPLICATIONS

This application claims the benefit under 35 USC 119(e) of prior U.S. Provisional Patent Application Ser. No. 63/327,389, filed Apr. 5, 2022, which is hereby incorporated by reference in its entirety.

FIELD OF THE INVENTION

The present application relates to a pre-assembled internal frame for a section of a modular wall.

SUMMARY OF THE INVENTION

One aspect of the application provides a pre-assembled internal frame for a modular wall. The frame comprises a pair of vertical frame members, each vertical frame member having a central web extending in a depth direction of the frame between a first flange and a second flange. Each of the first and second flanges extends laterally inwardly from the central web. The central web of each vertical frame member has a stepped configuration comprising a first web section extending inwardly in the depth direction from the first flange, a second web section extending inwardly in the depth direction from the second flange and offset laterally from the first web section, and a transition web section extending laterally to connect the first and second web sections. A plurality of horizontal frame members extend laterally between the vertical frame members to connect the vertical frame members together.

Each first flange has a pair of series of vertically arranged mounting openings, and each second flange has a single series of vertically arranged mounting openings. The vertical frame members are oriented in an inverted relationship with respect to one another such that (a) the first flange of one of the pair and the second flange of the other of the pair are positioned on one face of the frame and (b) the second flange of the one of the pair and the first flange of the other of the pair are positioned on an opposing face of the frame, thus enabling the frame to be arranged in an end to end junction with another frame with adjacent vertical frame members thereof abutting and the first and second flanges of the abutting vertical frame members positioned adjacent one another. This provides three of the series of vertically arranged openings on each side of the modular wall at the end to end junction.

Another aspect of the present application provides a method of installing a modular wall, which includes positioning a plurality of pre-assembled internal frames discussed above in a vertical orientation in alignment with one another to form an end-to-end junction between each adjacent pair of internal frames. In each adjacent pair, the first and second flanges of the abutting vertical frame members are positioned adjacent one another to provide three of the series of vertically arranged openings on each side of the modular wall at the corresponding end to end junction. The internal frames are secured to maintain the vertical orientation. The wall panels are mounted to opposing faces of the internal frames, wherein each wall panel has a plurality of mounting inserts on an inner face thereof at opposing lateral edges thereof. Each wall panel is mounted by inserting the mounting inserts at one lateral edge thereof into an inner one of the series of vertically arranged openings on the first flange of the corresponding internal frame and inserting the mounting inserts at the other lateral edge thereof into the series of vertically arranged openings on the second flange of the corresponding internal frame.

Another aspect of the present application provides a pre-assembled internal frame for a modular wall. The frame comprises a pair of vertical frame members, each vertical frame member having a central web extending in a depth direction of the frame between a first flange and a second flange. Each of the first and second flanges extend laterally inwardly from the central web. The central web of each vertical frame member has a stepped configuration comprising a first web section extending inwardly in the depth direction from the first flange, a second web section extending inwardly in the depth direction from the second flange and offset laterally from the first web section, and a transition web section extending laterally to connect the first and second web sections. A plurality of horizontal frame members extend laterally between the vertical frame members to connect the vertical frame members together.

Each first flange has a series of vertically arranged mounting openings, and each second flange has a series of vertically arranged mounting openings. The vertical frame members are oriented in an inverted relationship with respect to one another such that (a) the first flange of one of the pair and the second flange of the other of the pair are positioned on one face of the frame and (b) the second flange of the one of the pair and the first flange of the other of the pair are positioned on an opposing face of the frame. This enables the frame to be arranged in an end to end junction with another such frame with adjacent vertical frame members thereof abutting and the first and second flanges of the abutting vertical frame members positioned adjacent one another at the end to end junction. The plurality of horizontal frame members includes at least one intermediate horizontal frame member spaced vertically from the top and bottom of the frame. Each of the first and second web sections includes a fastener receiving portion. Each fastener receiving portion has a fastener receiving opening corresponding to each intermediate horizontal frame member and a fastener positioned therein for fastening the horizontal frame member to the vertical frame members. The fastener receiving portions are recessed laterally inwardly from the first and second web sections for avoiding interference between adjacent fasteners when the frame is arranged in the end to end junction with another such frame.

Another aspect of the present application provides a method of installing a modular wall, which includes positioning a plurality of pre-assembled internal frames discussed above in a vertical orientation in alignment with one another to form an end-to-end junction between each adjacent pair of internal frames. The internal frames are secured to maintain the vertical orientation. Wall panels are mounted to opposing faces of the internal frames, wherein each wall panel has a plurality of mounting inserts on an inner face thereof at opposing lateral edges thereof. Each wall panel is mounted by inserting the mounting inserts at one lateral edge thereof into the series of vertically arranged openings on the first flange of the corresponding internal frame and inserting the mounting inserts at the other lateral edge thereof into the series of vertically arranged openings on the second flange of the corresponding internal frame.

Another aspect of the present application provides a shipping container comprising a plurality of the pre-assembled internal frames stacked in face-to-face relation.

Other objects, features, and advantages of the present invention will become apparent from the following detailed description, the accompanying drawings, and the appended claims.

DETAILED DESCRIPTION OF THE ILLUSTRATED EMBODIMENT(S)

Figure 1:
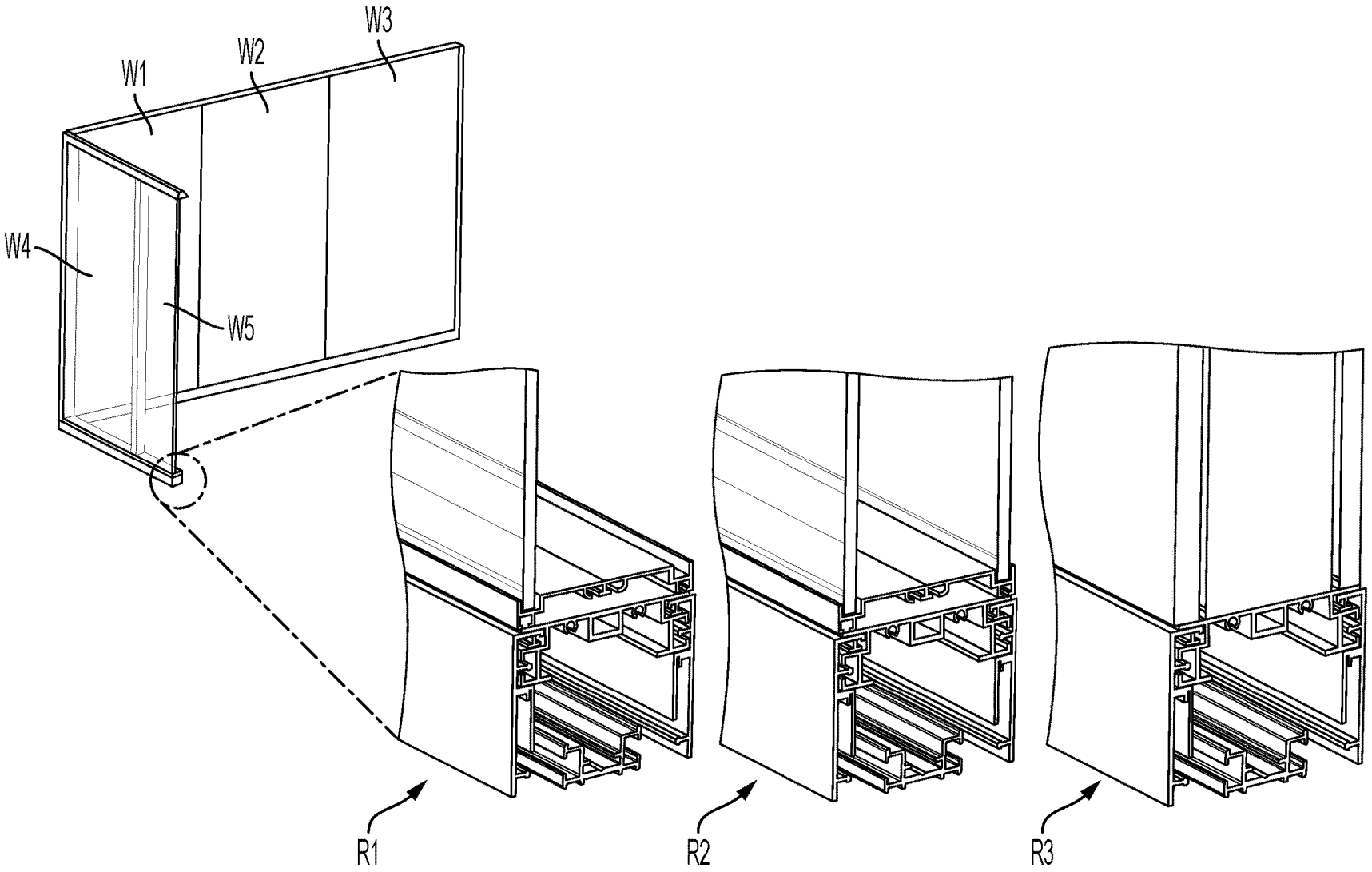
FIG. 1 shows an example of a partially constructed office space formed from modular walls where walls meet at corner and end-to-end junctions.

FIG. 1 shows an example of a partially constructed office space formed from modular walls formed of wall sections where walls meet at corner and end-to-end junctions. The space constructed need not be office related, and can be any setting, including residential, factory, educational, or otherwise. The office example is not limiting and is used for illustrative context.

Modular walls typically have a frame supporting panels of a variety of styles. Such panels may be wood, frameless glass (or another translucent or transparent material), back painted or frosted glass (or other translucent or transparent material), framed glass, gypsum, fiberboard, sheet metal, canvas exterior, etc. Any such panels can also be finished or covered with different treatments. Such panels can also be functional components, like a whiteboard, display screen, etc. The types of modular walls and panels thereof is not limiting and the examples mentioned herein are exemplary only.

In FIG. 1, for example, wall sections W1, W2 and W3 are shown meeting at end-to-end junctions, and wall sections W1 and W4 are shown meeting at a corner junction. A partial, cut-away wall section W5 also shown meeting wall section W4 at an end-to-end junction. Wall sections W1-W3 are shown as having wood, fiberboard or other non-transparent material, while wall sections W4 and W5 are glass wall sections. FIG. 1 also shows a detailed view of different options for a bottom rail of wall sections W4 and W5, including a version R1 for mounting a single pane of glass, a version R2 for mounting two panes of glass, and a version where the glass is replaced with two solid wood or fiberboard panels with acoustic dampening material therebetween (which may be used for wall sections W1-W3). These examples are not limiting, and are provided simply to provide context of the types of wall sections that can be connected together using the features described herein below.

Figure 2:
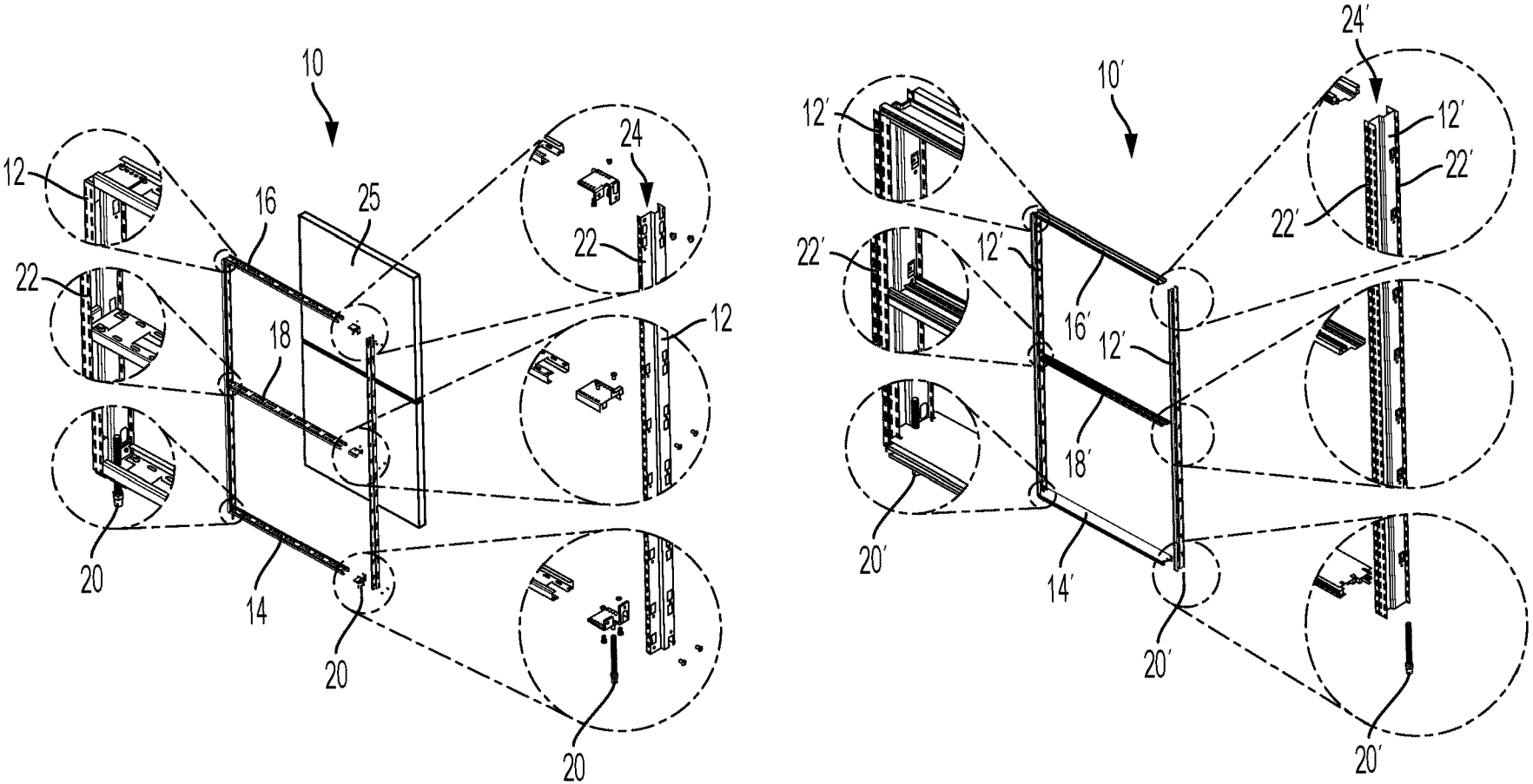
FIG. 2 shows perspective exploded views of exemplary pre-assembled internal frames for a modular wall section.

FIG. 2 shows examples of internal frame assemblies 10 and 10' used for mounting wall panels made of wood, fiberboard, gypsum, etc., or framed glass panels. The frame are shipped pre-assembled and installed at the installation site (e.g., an office location). Corresponding parts for the second example 10' are denoted with a ' on the reference number. The frame 10, 10' generally includes a pair of vertical rail members 12, 12', a bottom rail 14, 14', a top rail 16, 16' and at least one intermediate horizontal rail 18, 18'. These rails are assembled together using any types of fasteners. The bottom rail 14 or vertical rail member 12' has a height adjuster 20, 20', respectively, that can be used to vertically adjust a height of the internal frame member 10, 10' to better match the ceiling and align components as needed.

The vertical frame members 12, 12' each have a series of vertically arranged openings 22, 22' for mounting wall panels 25 during installation of the wall section. These openings 22, 22' may also be used for mounting other accessories, as will be discussed hereinbelow. The frame members 12, 12' may also have a stepped configuration 24, 24' discussed in detail below.

Figure 3:
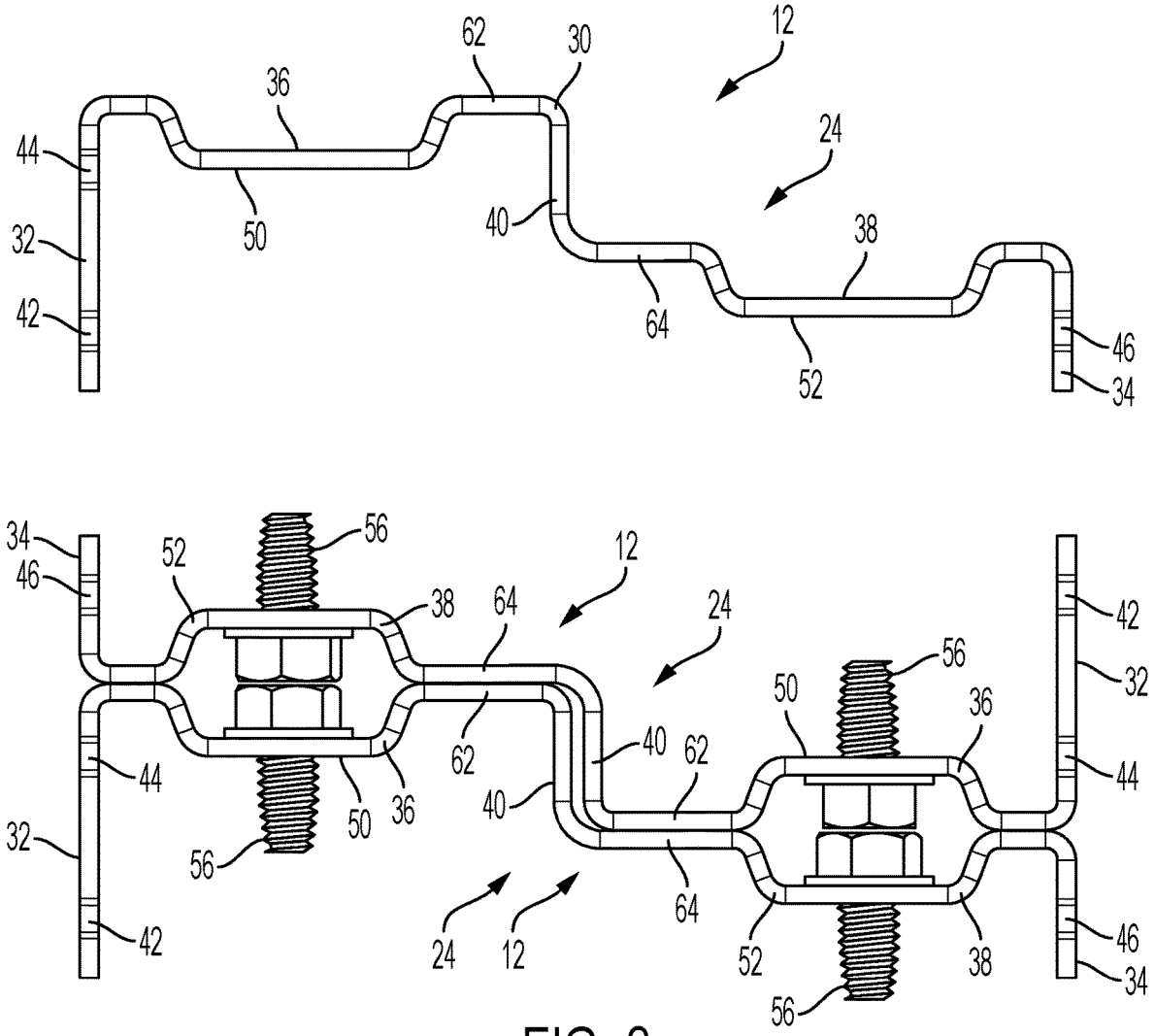
FIG. 3 shows a cross-sectional view of a vertical frame member and an end view of a pair of such vertical frame members from adjacent wall sections featured together.

FIG. 3 shows an example of a vertical frame member, which will be numbered 12 for convenience (and which could be any vertical frame member, and is only provided for context).

The vertical frame member 12 in FIG. 3 is included in a pre-assembled internal frame for a modular wall section, which has a pair of the frame members 12 at the opposing ends thereof. Each vertical frame member 12 has a central web 30 extending in a depth direction of the frame (i.e. to the right-left in FIG. 3, which is the depth or thickness direction of the finalized wall section). The central web section 30 extends between a first flange 32 and a second flange 34. Each of the first and second flanges 32, 34 extends laterally inwardly from the central web 30. Here, laterally inwardly refers to inwardly in the lateral direction of the wall section. The bottom image in FIG. 3 shows the vertical frame members 12 of two different wall sections abutting in end-to-end relation, and the flanges 32, 34 of each extends laterally inwardly with respect to its associated wall section.

The central web 30 of each vertical frame member 12 has the stepped configuration 24 mentioned above, which comprises a first web section 36 extending inwardly in the depth direction from the first flange 32, and a second web section 38 extending inwardly in the depth direction from the second flange 34. The second web section 38 is offset laterally (in the wall section direction) from the first web section 36. The second section 38 is shown offset laterally inwardly from the first web section 36, but the arrangement can also be reversed with the second section offset laterally outwardly from the first web section 36. A transition web section 40 extends laterally to connect the first and second web sections 36, 48. The transition web section 40 is illustrated as perpendicular to the web sections 34, 36, but it could have a different orientation, such as diagonal, undulated, or any other configuration to create any stepped configuration. The stepped configuration shown is not intended to be limiting.

Each first flange 32 has a pair of series of vertically arranged mounting openings 42, 44, and each second flange 34 has a single series of vertically arranged mounting openings 46. In the pre-assembled frame 10, 10', the pair of vertical frame members 12 are oriented in an inverted relationship with respect to one another such that the first flange 32 of one of the pair and the second flange 34 of the other of the pair are positioned on one outer face of the frame and the second flange 34 of the first one of the pair and the first flange 32 of the other of the pair are positioned on an opposing outer face of the frame. That is, the vertical frame member 12 at the top of FIG. 3 is assembled in the frame in the manner shown, and the other vertical frame member 12 of that same frame at the opposite end is assembled in an inverted or flipped manner so that its first flange 32 is on the same outer face as the second flange 34 illustrated and its second flange is on the same opposing face as the first flange 32 illustrated. This can be seen in the details on the left side of FIG. 2, where the face shown has a single series of openings at one end and a two series of openings on the other end (and the inverse would be seen when viewing the opposing face). This can also be seen in FIGS. 3, 8 and 9A-9C, where (for example) the vertical frame member 12 at the left side of one wall section (e.g., the top one of the two) is inverted with respect to the vertical frame member at the right side of an adjacent wall section (e.g., the bottom one of the two).

Figure 8:
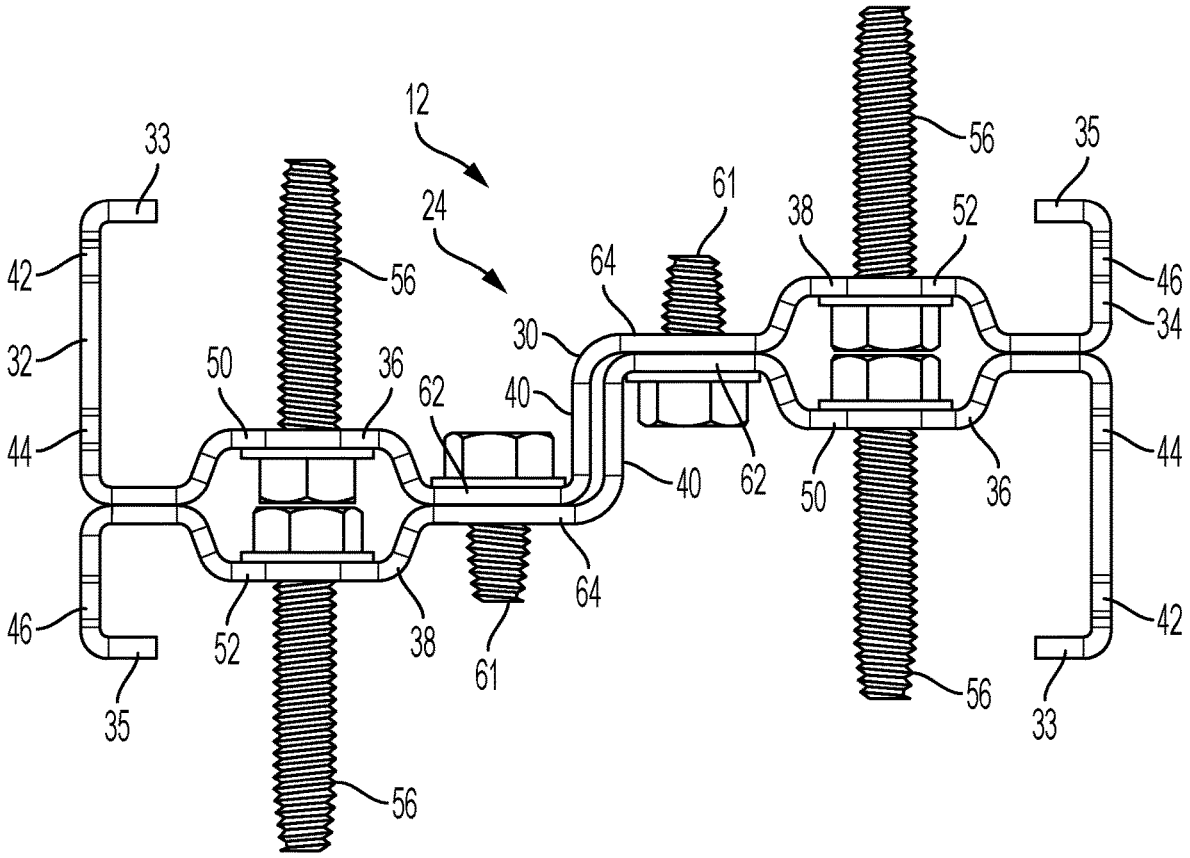
FIG. 8 is a view similar to FIG. 3 of an alternative embodiment

FIG. 8 also shows a design similar to FIG. 3 where the flanges 32, 34 have inwardly bent ends (also called returns) 33, 35 for providing the flanges with additional stiffness or rigidity.

This inverted arrangement of the frame members 12 in the same frame 10 enables the frame 10 to be arranged in an end to end junction with another frame 10 with adjacent vertical frame members 12 thereof abutting, as shown in the bottom image of FIG. 3. In that bottom image, the top frame member 12 is from the frame 10 for one wall section and the bottom frame member is from the frame 10 of an adjacent wall section. The first and second flanges 32, 34 of the abutting vertical frame members from the two adjacent end-to-end frames are thus positioned adjacent one another to provide three of the series of vertically arranged openings 42, 44, 46 on each side or face of the modular wall at the end to end junction of the two wall sections. This can be appreciated from the bottom image of FIG. 3 and FIG. 8, where the first flange 32 from the top frame member 12 and the second flange 34 from the bottom frame member 12 are adjacent, thus providing all three series of openings 42, 44, 46 at that junction at one face of the modular wall, and the inverse is shown at the other face. The same can also be seen in the perspective of FIG. 4 and in the views of FIGS. 9A-C.

As mentioned, the pre-assembled frame 10 includes a plurality of horizontal frame members, e.g., 14, 16, 18, extending laterally between the vertical frame members 12 to connect the vertical frame members together, typically in parallel relation. Any horizontal frame members may be used, and those illustrated are not intended to be limiting.

Typically, the plurality of horizontal frame members includes at least one intermediate horizontal frame member (e.g., 18) spaced vertically from the top and bottom of the frame. In the illustrated vertical frame member 12, each of the first and second web sections 36, 38 optionally includes a fastener receiving portion 50, 52. Each fastener receiving portion 50, 52 has a fastener receiving opening 54 corresponding to each intermediate horizontal frame member 18 and a fastener 56 positioned therein for fastening the horizontal frame member to the vertical frame members 12. Each frame member 12 may have a plurality of the openings 54 so that multiple horizontal frame members can be included in the pre-assembled frame, or so that the different numbers or vertical locations of horizontal frame members can be varied depending on the application or final design needs.

Optionally, but not necessarily, fastener receiving portions 50, 52 are recessed laterally inwardly from the first and second web sections 36, 38, respectively for avoiding interference between adjacent fasteners 56 when the pre-assembled frame 10 is arranged in the end to end junction with another pre-assembled frame 10. This can be seen in FIG. 3 in the bottom image, where the fasteners have heads. The inwardly recessing allows the heads to be close to one another without interference with one another, thus allowing the frame members 12 to be closely abutted. This may be advantageously used where the horizontal frame members are attached by any type of fasteners that project through the web sections 36, 38, including screws, bolt, nuts/bolts, inserts, keys or the like. This recessed configuration is optional, and may not be needed depending on the manner in which the horizontal frame member is connected. For example, if the horizontal frame member is held by clips, welding, snap-fit, or other types of fasteners, the design may not create interference and thus recessing is not needed. The fasteners shown are not limiting.

The pre-assembled frame's horizontal frame members may include a bottom horizontal frame member 14 and/or a top horizontal frame member 16. These frame members may also have any construction or configuration. These may be connected differently or in the same manner.

The pre-assembled frame member may also include plurality of height adjusters 20, 20' on a bottom of the frame, as mentioned above. Each height adjuster 20, 20' has a floor engaging foot and is operable to extend the foot downwardly to raise the internal frame and retract the foot upwardly to lower the internal frame. For example, the foot may be on a linear screw that is rotated to extend/retract the foot. These may be used for making final adjustments and alignments after the frame is initially installed. This may be done before or after the panels are installed to the frame.

As mentioned above, the height adjusters include a height adjuster 20' mounted to a bottom end of each vertical frame member 12'. Alternatively, the height adjusters may include height adjusters 20 mounted to the bottom horizontal frame member 14.

Any type of height adjuster may be used for making such adjustments, and the examples shown are not intended to be limiting.

Figure 4:
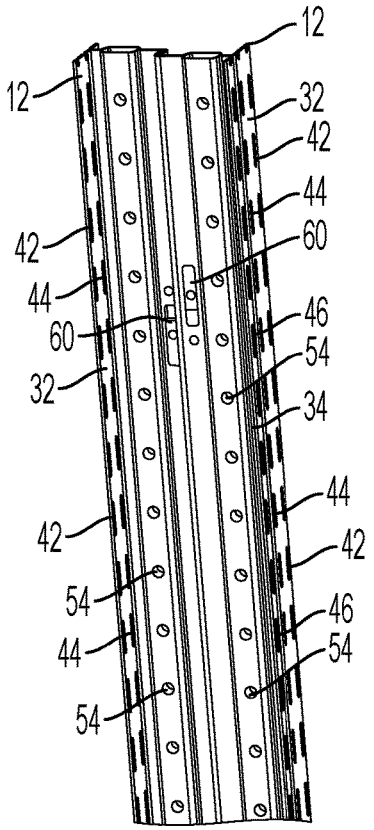
FIG. 4 shows a perspective view of a pair of vertical frame members from adjacent wall sections and an example of different accessories mounted to a wall system.
Figure 4:
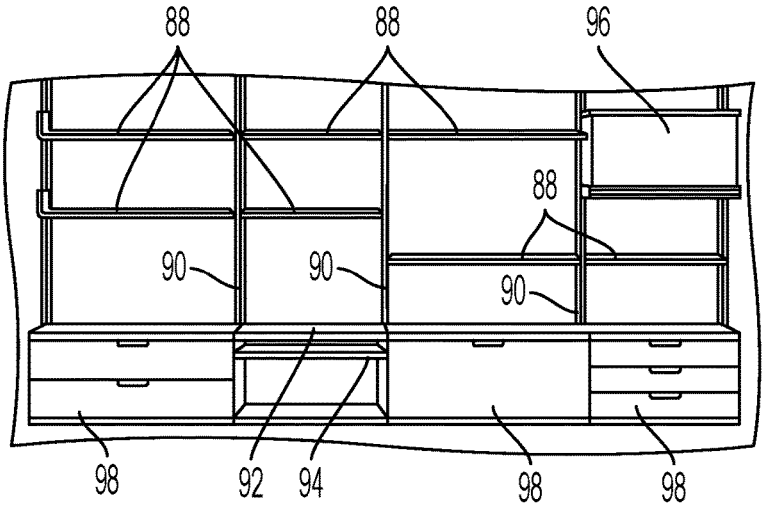

As a non-limiting feature, the central web section 30 of each vertical member 12 has an elongated fastener receiving slot 60 formed therethrough for receiving a fastener (not shown) for connecting the vertical frame member 12 to the adjacent vertical frame member 12 of another frame 10 when arranged in the end-to-end junction. The elongation is in the vertical direction, as shown in FIG. 4 to accommodate vertical variance. For example, in the embodiments of FIGS. 3 and 8, the slots may be provided on one or each first and second web sections 36, 38, such as on the intermediate wall portions 62, 64 that extend between the opposing ends of the transition portion 40 and the fastener receiving portions 50, 52. The fastener(s) (61 in FIG. 8) used may be of any types, including screws, nuts/bolts, clips, inserts, snap-fits, etc. The elongation of the slots 60 allows for vertical differences between the adjacent frame members 12, which could arise because of an uneven/sloped floor, an uneven/sloped ceiling, tolerance variations in manufacturing, or the like. Thus, the slots 60 allow for fastening to occur, even if vertical alignment is not exact.

Figure 9C:
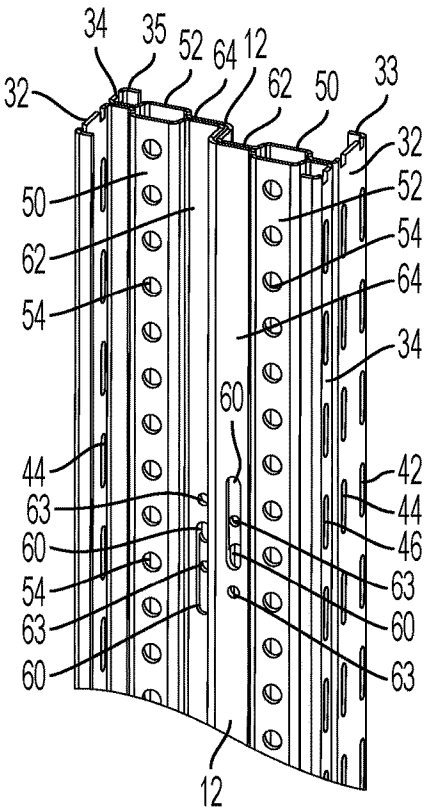
FIGS. 9A-C are various views of vertical frame members of two adjacent wall sections abutted in end-to-end relation.
Figure 9B:
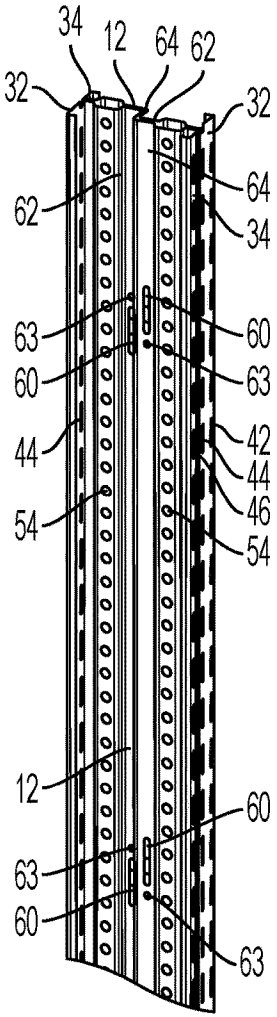
Figure 9A:
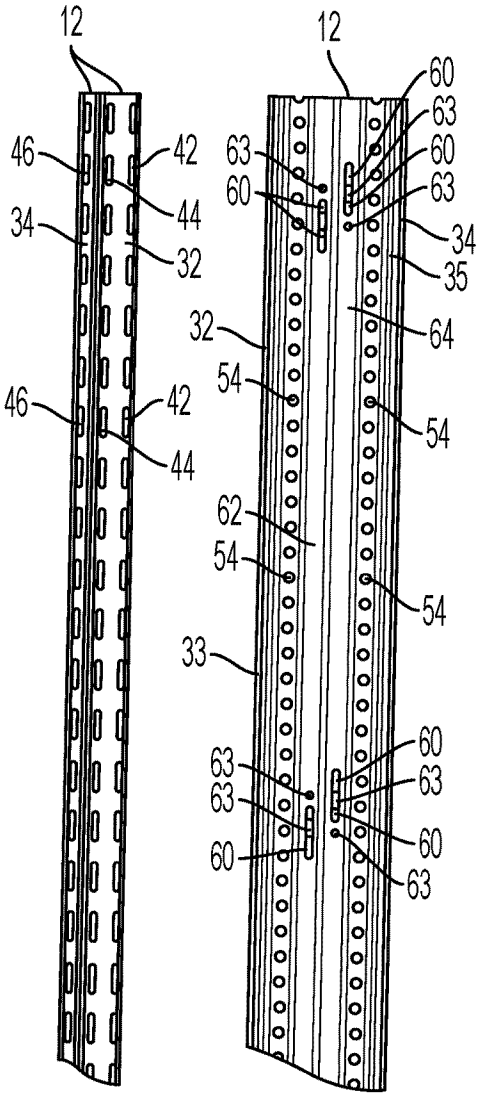

As can be seen in FIGS. 9A-C, in a non-limiting optional configuration, each vertically aligned slots 60 may have a non-elongated fastener receiving opening 63 spaced vertically therefrom (which is shown as circular, but may have a different shape, such as square, hexagonal or the like). When adjacent frame members 12 of two adjacent wall sections are abutted, the openings 63 on one vertical member 12 will align with the elongated openings 60 on the other frame member 12. Thus, the vertical variance can be accommodated, while keeping the fastener itself from moving vertically relative to the frame member with the opening 63 in which it is inserted. These openings 60, 63 may be formed in an inverted relationship, such as that shown. In the illustrated design, one set of openings 60, 63 on one wall portion 62, 64 is arranged with opening 63 above opening 60 (referring to the directions of FIG. 9), and the other set of openings on the other wall portion 62, 64 is arranged with opening 63 below opening 60. With this arrangement, because the adjacent vertical members 12 of adjacent wall sections will be inverted relative to one another when installed (as discussed below), this ensures each opening 63 on one of the adjacent vertical members 12 is aligned with a corresponding elongated opening 60 on the other adjacent vertical member 12, thus accommodating the vertical variance. This is non-limiting, and it is also possible to use elongated openings 63 only.

As an additional non-limiting advantage, in embodiments where the pre-assembled frame includes height adjusters, the adjacent vertical frame members 12 of two wall sections can be connected in an end-to-end junction with the fastener (s) 61 in the slots 60 thereof, and the vertical elongation allows each frame to be vertical adjusted individually. Thus, the installer can complete the basic or rough installation of the wall sections, and make adjustments thereafter with the vertically elongated slots 60 allowing the frame member 12 of each wall section to move vertically relative to the adjacent frame member 12.

The vertical frame members 12 can be manufactured in any manner. The illustrated embodiments use any approach where the various portions/sections illustrated of a member are formed as one continuous, integral piece from a single piece of material. For example, rolling forming may be used, and particularly progressive roll-forming. Progressive roll forming can be used to punch all the openings needed in an initial flat blank of metal in an initial rolling forming die, and the metal blank can thereafter be deformed into its final configuration by one or more subsequent roll-forming steps. This allows for formation of all the needed openings first, and then deformation of the flanges, etc. Other methods can be used, including extrusion, casting, press-forming, stamping or the like. A mixture of techniques can be practiced, such as initially stamping a blank to form the openings and then roll forming the blank. For non-metal materials, molding techniques may also be used.

Figure 7:
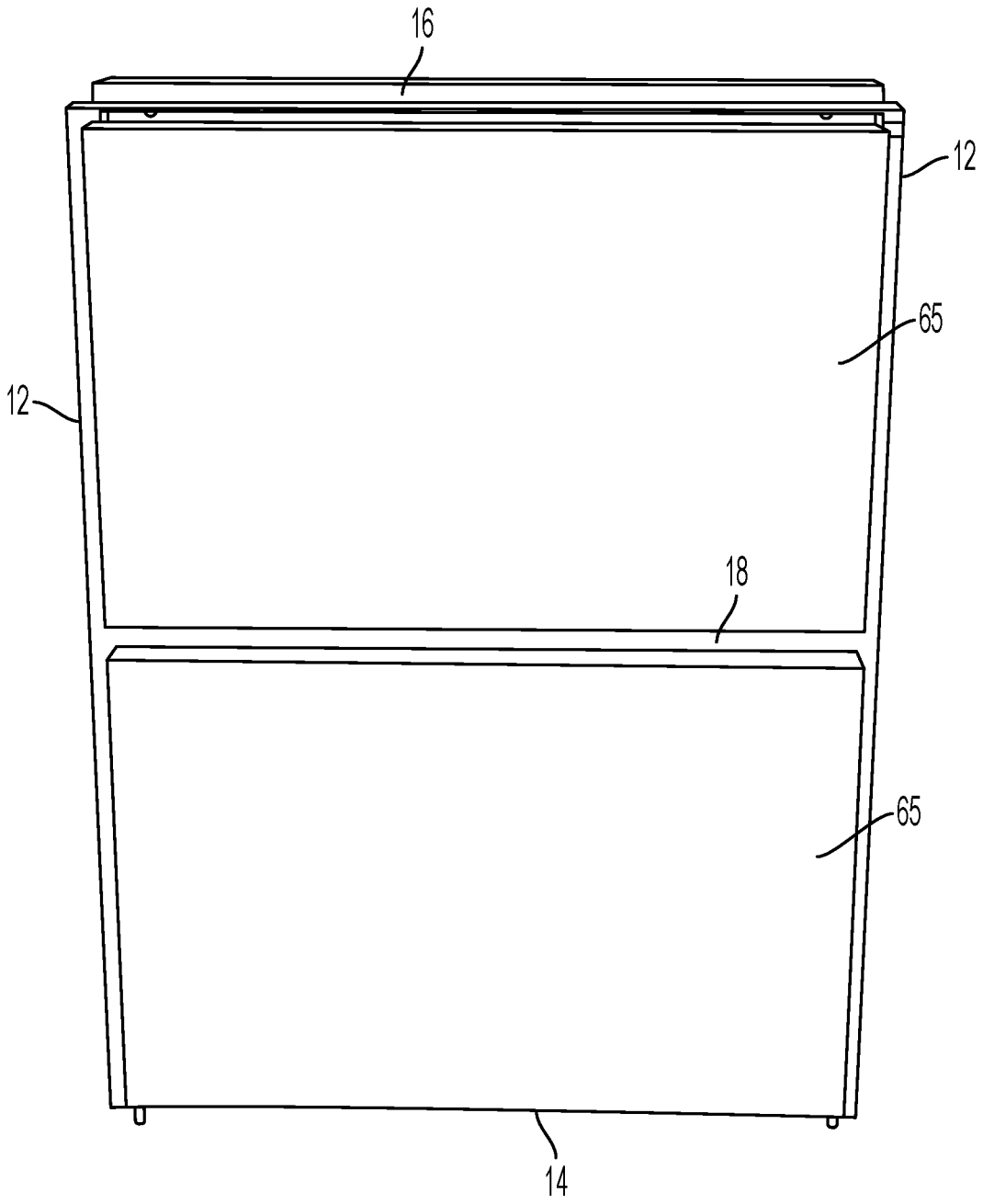
FIG. 7 shows a pre-assembled internal frame with acoustic dampening sections added thereto.

Because the pre-assembled internal frame is made at a manufacturing location rather than at the installation site, it can have other functional elements included therein, such as wiring connections, network cable connections, phone line connections, or the like. Also, as shown in FIG. 7, one or more acoustic dampening panels 65 (such as foam, rubber, or another material with acoustic dampening qualities) may be included in the pre-assembled frame and mounted between the vertical frame members 12.

Figure 5:
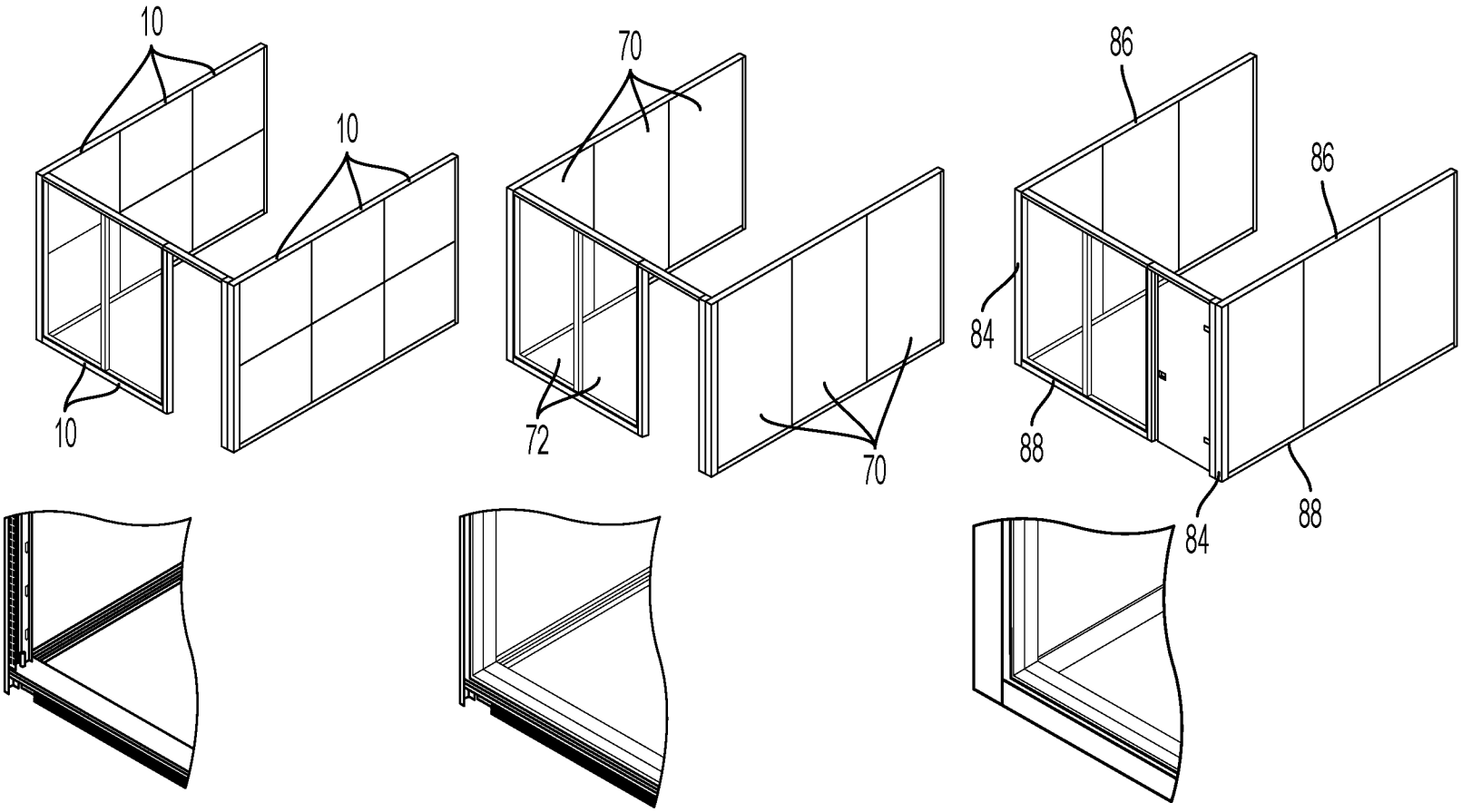
FIG. 5 shows a generalized sequence of assembly for a wall system using pre-assembled internal frames.

At the installation site, the internal frames are delivered pre-assembled without the wall panels mounted thereto. The modular wall can be installed by positioning a plurality of pre-assembled internal frames 10 (one for each wall section) according to any embodiment in a vertical orientation in alignment with one another to form an end-to-end junction between each adjacent pair of internal frames 10. In addition to the Figures above, FIG. 5 illustrates the basic installation sequence in a generalized manner for non-limiting, explanatory context. The left image of FIG. 5 shows the internal frames 10 being installed to create a general office space with the side walls having acoustic dampening material in the frames 10 of the wall sections and the front wall sections having no acoustic dampening materials, as they will receive glass panels. As mentioned above, each adjacent pair of the first and second flanges 32, 34 of the abutting vertical frame members 12 are positioned adjacent one another provide three of the series of vertically arranged openings 42, 44, 46 on each side of the modular wall at the corresponding end to end junction of the adjacent wall sections.

The internal frames 10 are secured to maintain the vertical orientation during installation. As mentioned above, this may include fastening adjacent vertical frame members 12 of adjacent wall sections together. It may also include fastening the top rails to the ceiling, or other techniques for securing the wall sections in their vertical orientation.

Optionally, if any internal components are to be mounted in any wall section during installation, this can be done while the internal frames are installed and before the wall panels are mounted. For example, if any electrical wires, networks cables, ventilation routing, or the like is need, these can be installed at this time (if not already pre-installed at the manufacturing site). Also, by having the frame members installed initially, the vertical adjustments using the height adjuster(s) can be made at this time. As mentioned above, in an embodiment where the vertical frame members 12 of each adjacent pair of wall sections are fastened with fasteners through corresponding aligned elongated fastener receiving slots 60 thereof, after the fastening the height of each wall section in each adjacent pair can be adjusted individually using one or more of the height adjusters with the elongated fastener receiving slots 60 allowing vertical variance as the height is adjusted.

A non-limiting advantage of having the pre-assembled frames 10 installed without the panels is inspection and evaluation of the layout, any electrical approvals, or the like can be conducted and adjustments, modifications, or re-arrangements can be made more easily. Another non-limiting advantage is that the frames can be installed not just more quickly because they are pre-assembled, they can also be installed by less skilled (and typically less expensive laborers) as a possibility to save costs.

Next, the wall panels 70 may be mounted to the opposing faces of the internal frames 10. In the middle image of FIG. 5, the wall panels 70 on the wall sections of the side walls are wood, fiberboard, canvas or textile covered sections, or the like, while the panels for the front wall sections are framed glass panels 72. These are non-limiting examples. As further examples, a panel may also be or include a functional component, and such as an electronic display (e.g., a display screen), a regular or interactive electronic whiteboard, chalkboard or the like, as mentioned above. Each wall panel 70, 72 has a plurality of mounting inserts 74 on an inner face thereof at opposing lateral edges thereof. Each wall panel 70, 72 is mounted by inserting the mounting inserts 74 at one lateral edge thereof into an inner one of the series of vertically arranged openings 42 on the first flange 32 of the corresponding internal frame 10 and inserting the mounting inserts 74 at the other lateral edge thereof into the series of vertically arranged openings 46 on the second flange 34 of the corresponding internal frame. This may be done on both faces of the frame such that the opposing wall panel 70, 72 is connected in the same manner, albeit with the insertion of the openings being inverted because the other frame member 12 is inverted.

Figure 6:
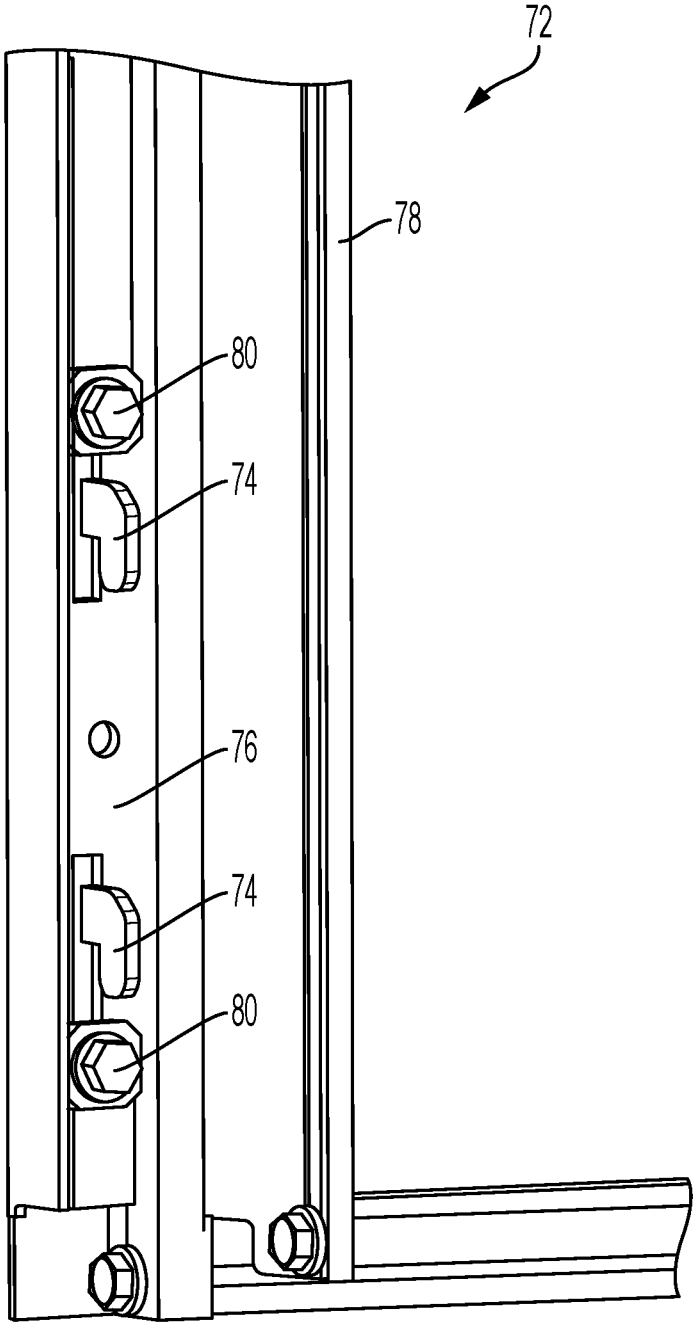
FIG. 6 is a perspective view of part of an end panel for mounting to a pre-assembled internal frame.

FIG. 6 shows an example of the mounting inserts 74 on the non-limiting context of a framed glass panel. The same mounting inserts 74 could be provided on any other type of panel, and can have any construction or configuration. In the non-limiting design of FIG. 6, the mounting inserts 74 are hooks or fingers punched, stamped, or otherwise formed from a flat metal plate 76 formed as a bracket. The plates 76 are fastened to a frame 78 of the panel at the lateral edges thereof by any types of fasteners, such as bolts or screws 80. Welding, snap-fits, or any other types of fasteners may also be used. The inserts 74 are configured to be received in the openings 42, 46 on the flanges 32, 34 when the panel 70, 72 is mounted, this providing for easy and fast installation of the panels to the already-installed pre-assembled frames 10. Any number of these mounting inserts 74 and brackets may be provided on each lateral side.

The vertical adjustments mentioned above may also take place after the wall panels 70, 72 are mounted but before the trim members are installed also, as it may be easier to see any alignment issues after the wall panels 70, 72 are installed. Even if vertical adjustments happened before the wall panels 70, 72 were mounted, further adjustments can also be made after they are installed if needed.

After the wall panels 70, 72 are installed, the wall system can be completed with the addition of fascia trim members. In FIG. 5, this is illustrated by the addition of corner trim members 84 at the corner junctions between the front and side wall sections 70, 72, top trim members 86 extending horizontally along the top frame members, and bottom trim members 88 extending horizontally along the bottom frame members. These trim members can match the extent of an individual wall section or can be extend over the course of two or more wall sections. The particular trim members used and how they are mounted is not intended to be limiting, and any type of trim member may be used. Trim members where the wall sections meet at an end-to-end junction are another option discussed below.

Optionally, the adjacent wall panels (e.g., 70 and 70 or 72 and 72 in FIG. 5) have a gap 90 (see FIG. 4) between vertical edges thereof to leave an outer one of the series 44 of the vertically arranged openings on the first flange 32 exposed (which is the middle one of a set of three). That is, the one of the two adjacent panels is mounted to the inner openings 42 on the first flange 32 of its associated frame member 12 and the other of the two adjacent panels is mounted to the single openings 46 on the second flange 34 of its associated frame member 12, which can be appreciated from the arrangement shown in FIG. 3. This leaves the outer series of openings 44 on the first flanges 32 exposed via the gap 90 between the two adjacent panels.

Using that gap 90 enables at least one accessory structure to be mounted to the exposed outer series of vertically arranged openings 44 at the area between the two adjacent panels. An accessory structure can include any type of structure, and may include a fascia trim member for covering the gap if desired. Alternatively, the accessory structure can be a functional accessory, such as a shelf, a receptacle, an electronic device, a desk, a computer monitor support, or a lighting device, a hanger support, a picture or painting frame, a clothing rack, an acoustical dampening panel, a fan, a slat wall panel, or a sign. These accessory structures can be mounted using mounting inserts like the mounting inserts 74 discussed above used for mounting the wall panels.

For example, to provide non-limiting context, FIG. 4 includes an image of a series of wall sections installed in end-to-end junctions with various accessory structures. A series of shelves 88 are mounted to the openings 44 exposed between the gaps 90. A desk or work surface 92 is also mounted in the same manner, with a slidable keyboard tray 94 mounted below it. A display screen, e.g., a TV monitor 96 is also mounted in the same manner. Similar, various drawers or other storage areas 98 are also mounted in the same manner. Any types of accessories or combination of accessories may be mounted in this manner. Also, shorter sections of trim members may be used to cover the portions of the gaps 90 above or below an accessory. For example, in FIG. 4 such trim members could be added in the areas between the vertically spaced shelves 88 and/or between the shelves and the drawers 98 to conceal the gaps 90.

In some embodiments, the gap need not be used. For example, in some situations there may be no need to provide any mounting of an accessory structure and the aesthetic preference is to avoid using trim members to cover the gap 90. Thus, wall panels of a slightly larger width can be used so that their vertical edges meet and cover the openings 44, thus providing no visible gap.

One advantage of the modular design is that upgrades can be easily made after installation is complete. For example, if customer wants a different aesthetic appearance, trim members can be removed and replaced easily as an upgrade change. As another example, after the wall system is installed, a customer may decide to add shelving or another functional accessory structure. In that case, trim members covering gaps 90 can be removed (if used) and the shelves can be installed on the openings 44 in those gaps 90. Likewise, if a customer decides to upgrade a conference room to add a large display screen, a wall panel can be removed and a display screen can be mounted in place of the removed wall panel. Also, different panels can be swapped out for an aesthetic upgrade in a straightforward manner. Any number of modifications and variations can be made during or after the installation process is completed.

Figure 10:
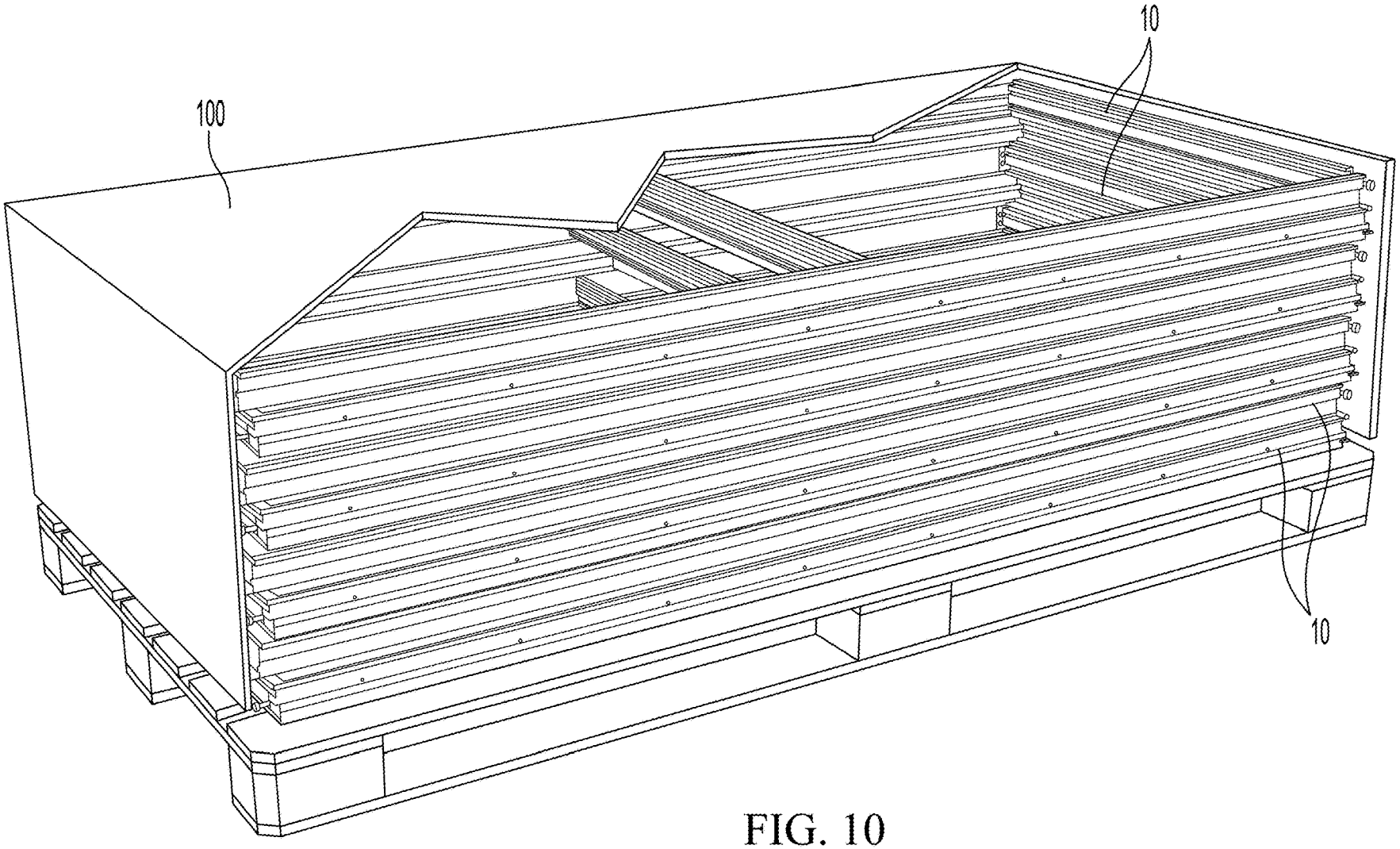
FIG. 10 shows a plurality of the pre-assembled frames stacked together, with a container shown schematically and in partial cross-section to show the stacked frames.

One advantage of the frames being pre-assembled is that they can be shipped to the installation site and be erected quickly and easily. Preferably, the pre-assembled internal frames are shipped in a container (e.g., a box, packing crate or the like) stacked in face to face relationship. More preferably, the container will have no wall panels inside (i.e., it is devoid of wall panels). Because the frame members are more roughly constructed and tends to have edges, corners, flanges, etc. made of rigid material, they could scratch or damage the wall panels if shipped together in the same container absent including additional protective material (which increases costs). An example of such a container is shown schematically at 100 in FIG. 10 where the frames (e.g. frames 10) have no wall panels. Also, the pre-assembled frames are designed to be erected without the wall panels, so delivery can be staged and better managed. Likewise, the manufacturing of the frames and the wall panels involve different techniques, as the frame involve more traditional metal or plastic manufacturing whereas the wall panels involve finer handling due to being made of wood, glass, textile and the like. Thus, separate shipping enables them to be shipped from different manufacturing locations if needed.

The pre-assembled internal frames can also be made of the manufacturing location for mounting of different panels. For example, as can be appreciated from FIGS. 1 and 5, single or double channel tracks can be used for single or double pane glass (or other transparent or translucent material) wall sections, with no intermediate horizontal rail. Likewise, a frame can be constructed with one or more intermediate horizontal frame members for wall sections with non-transparent panels, e.g., wood, textile, gypsum, fiberboard, etc. Any designs can be used to match the intended panel and other functional features.

The foregoing embodiments have been provided solely to illustrate the structural and functional principles of the present invention and are not intended to be limiting. To the contrary, the present invention includes all substitutions, modifications, alterations and equivalents within the spirit and scope of the following claims.

What is claimed:

1. A pre-assembled internal frame for a modular wall, comprising:

a pair of vertical frame members, each vertical frame member of the pair of vertical frame members having a central web extending in a depth direction of the pre-assembled internal frame between a first flange and a second flange, each of the first and second flanges extending laterally inwardly from the central web;

wherein the central web of each vertical frame member of the pair of vertical frame members has a stepped configuration comprising a first web section extending inwardly in the depth direction from the first flange, a second web section extending inwardly in the depth direction from the second flange and offset laterally from the first web section, and a transition web section extending laterally to connect the first and second web sections to create the stepped configuration and offset laterally the second web section from the first web section;

a plurality of horizontal frame members extending laterally between the vertical frame members of the pair of vertical frame members to connect the vertical frame members together;

wherein each said first flange has a pair of series of vertically arranged mounting openings, and each said second flange has a single series of vertically arranged mounting openings, and wherein the vertical frame members of the pair of vertical frame members are oriented in an inverted relationship with respect to one another such that (a) the first flange of one of the pair of vertical frame members and the second flange of the other of the pair of vertical frame members are positioned on one face of the pre-assembled internal frame and (b) the second flange of said one of the pair of vertical frame members and the first flange of said other of said pair of vertical frame members are positioned on an opposing face of the pre-assembled internal frame, thus enabling said pre-assembled internal frame to be arranged in an end-to-end junction with another of said pre-assembled internal frame with adjacent said vertical frame members of the pre-assembled internal frames at the end-to-end junction abutting and the first and second flanges of the abutting vertical frame members positioned adjacent one another on opposing sides of the modular wall so that the adjacent first and second flanges on each said opposing side of the modular wall include the pair of series of vertically arranged openings on the first flange and the single series of vertically arranged openings on the second flange to together provide three of the series of vertically arranged openings on each said opposing side of the modular wall at the end-to-end junction.

2. The pre-assembled internal frame according to claim 1, wherein the plurality of horizontal frame members includes at least one intermediate horizontal frame member spaced vertically from the top and bottom of the pre-assembled internal frame, wherein each of the first and second web sections includes a fastener receiving portion, each said fastener receiving portion having a fastener receiving opening corresponding to an associated one of the at least one intermediate horizontal frame member and a fastener positioned therein for fastening the associated one of the at least one horizontal frame member to the vertical frame members of the pair of vertical frame members;

wherein said fastener receiving portions are recessed laterally inwardly from the first and second web sections for avoiding interference between adjacent fasteners when said pre-assembled internal frame is arranged in said end-to-end junction with another of said pre-assembled internal frame.

3. The pre-assembled internal frame according to claim 2, wherein the plurality of horizontal frame members further comprise a bottom horizontal frame member.

4. The pre-assembled internal frame according to claim 3, wherein the plurality of horizontal frame members further comprises a top horizontal frame member.

5. The pre-assembled internal frame according to claim 3, further comprising a plurality of height adjusters on a bottom of said pre-assembled internal frame, each of the plurality of height adjusters having a floor engaging foot and being operable to extend the floor engaging foot downwardly to raise the internal frame and retract the foot upwardly to lower the pre-assembled internal frame.

6. The pre-assembled internal frame according to claim 5, wherein the plurality of height adjusters include a height adjuster mounted to a bottom end of each vertical frame member of the pair of vertical frame members.

7. The pre-assembled internal frame according to claim 5, wherein the plurality of height adjusters include height adjusters mounted to the bottom horizontal frame member.

8. The pre-assembled internal frame according to claim 5, wherein at least one of the first and second web sections of the central web of each vertical frame member of the pair of vertical frame members has an intermediate wall portion extending between the recessed fastener receiving portion thereof and the transition web section, each of the intermediate wall portions having an elongated fastener receiving slot formed therethrough for receiving a fastener for connecting the vertical frame member to the adjacent vertical frame member of another said pre-assembled internal frame when arranged in the end-to-end junction, the fastener receiving slot being elongated in a vertical direction to accommodate a vertical variance.

9. The pre-assembled internal frame according to claim 8, wherein each of the first and second web sections of the central web of each vertical frame member of the pair of vertical frame members has the intermediate wall portion with the elongated fastener receiving slot.

10. The pre-assembled internal frame according to claim 2, wherein at least one of the first and second web sections of the central web of each vertical frame member of the pair of vertical frame members has an intermediate wall portion extending between the recessed fastener receiving portion thereof and the transition web section, each of the intermediate wall portions having an elongated fastener receiving slot formed therethrough for receiving a fastener for connecting the vertical frame member to the adjacent vertical frame member of another said pre-assembled internal frame when arranged in the end-to-end junction, the fastener receiving slot being elongated in a vertical direction to accommodate a vertical variance.

11. The pre-assembled internal frame according to claim 10, wherein each of the first and second web sections of the central web of each vertical frame member of the pair of vertical frame members has the intermediate wall portion with the elongated fastener receiving slot.

12. The pre-assembled internal frame according to claim 1, wherein the central web of each vertical member of the pair of vertical frame members has an elongated fastener receiving slot formed therethrough for receiving a fastener for connecting the vertical frame member to the adjacent vertical frame member of another said pre-assembled internal frame when arranged in the end-to-end junction, the fastener receiving slot being elongated in a vertical direction to accommodate a vertical variance.

13. The pre-assembled internal frame according to claim 1, further comprising a plurality of height adjusters on a bottom of said pre-assembled internal frame, each plurality of height adjusters having a floor engaging foot and being operable to extend the floor engaging foot downwardly to raise the internal frame and retract the foot upwardly to lower the pre-assembled internal frame.

14. The pre-assembled internal frame according to claim 13, wherein the central web of each vertical member of the pair of vertical frame members has an elongated fastener receiving slot formed therethrough for receiving a fastener for connecting the vertical frame member to the adjacent vertical frame member of another said pre-assembled internal frame when arranged in the end-to-end junction, the fastener receiving slot being elongated in a vertical direction to accommodate a vertical variance.

15. The pre-assembled internal frame according to claim 1, wherein said vertical frame members of the pair of vertical frame members are roll-formed.

16. The pre-assembled internal frame according to claim 1, wherein an acoustic dampening panel is mounted between and within the vertical frame members of the pair of vertical frame members.

17. A method of installing a modular wall, comprising:

positioning a plurality of pre-assembled internal frames according to claim 1 in a vertical orientation in alignment with one another to form an end-to-end junction between each of the adjacent pairs of the plurality of internal frames, wherein in each adjacent pair of pre-assembled internal frames the first and second flanges of the abutting vertical frame members are positioned adjacent one another on opposing sides of the modular wall so that the adjacent first and second flanges on each said opposing side of the modular wall include the pair of series of vertically arranged openings on the first flange and the single series of vertically arranged openings on the second flange to together provide three of the series of vertically arranged openings on each said opposing side of the modular wall at the corresponding end-to-end junction;

securing the internal frames to maintain the vertical orientation;

mounting wall panels to opposing faces of the internal frames, wherein each of the wall panels has a plurality of mounting inserts on an inner face thereof at opposing lateral edges thereof and each of the wall panels is mounted by inserting the mounting inserts at one lateral edge thereof into an inner one of the series of vertically arranged openings on the first flange of the corresponding internal frame and inserting the mounting inserts at the other lateral edge thereof into the series of vertically arranged openings on the second flange of the corresponding internal frame.

18. The method of claim 17, wherein adjacent wall panels have a gap between vertical edges thereof to leave an outer one of the series of the vertically arranged openings on a first flange exposed.

19. The method of claim 18, further comprising mounting at least one accessory structure to the exposed laterally outer one of the series of vertically arranged openings.

20. The method of claim 19, wherein the accessory structure is a fascia trim member for closing the gap.

21. The method of claim 19, wherein the accessory structure is a functional accessory selected from the group consisting of a shelf, a receptacle, an electronic device, a desk, a computer monitor support, a lighting device, a hanger support, a picture or painting frame, a clothing rack, an acoustical dampening panel, a fan, a slat wall panel, and a sign.

22. The method of claim 17, wherein each of the wall panels is selected from the group consisting of a wood panel, a fiberboard panel, a gypsum material panel, a plastic panel, a sheet metal panel, and a framed glass panel.

23. The method of claim 17, wherein at least one of the panels is an electronic display.

24. The method of claim 17, wherein the pre-assembled internal frames each further comprises a plurality of height adjusters on a bottom of said pre-assembled internal frame, each of the plurality of height adjusters having a floor engaging foot and being operable to extend the foot downwardly to raise the internal frame and retract the foot upwardly to lower the internal frame, and wherein the central web of each vertical member of the pair of vertical frame members has an elongated fastener receiving slot formed therethrough for receiving a fastener for connecting the vertical frame member to the adjacent vertical frame member of another said pre-assembled internal frame when arranged in the end-to-end junction, the fastener receiving slot being elongated in a vertical direction to accommodate a vertical variance;

wherein the method further comprises:

fastening the vertical frame members of the pair of vertical frame members of each of the adjacent pairs of the plurality of pre-assembled frames with fasteners through corresponding aligned elongated fastener receiving slots thereof, and after the fastening adjusting a height of each of the plurality of pre-assembled internal frames in each of the adjacent pairs of the plurality of pre-assembled internal frames individually with the elongated fastener receiving slots allowing vertical variance as the height is adjusted.

25. A shipping container comprising a plurality of the pre-assembled internal frames of claim 1 stacked in a face-to-face relation.

26. The shipping container according to claim 25, wherein the shipping container is devoid of wall panels.

27. A pre-assembled internal frame for a modular wall, comprising:

a pair of vertical frame members, each vertical frame member of the pair of vertical frame members having a central web extending in a depth direction of the pre-assembled internal frame between a first flange and a second flange, each of the first and second flanges extending laterally inwardly from the central web;

wherein the central web of each vertical frame member of the pair of vertical frame members has a stepped configuration comprising a first web section extending inwardly in the depth direction from the first flange, a second web section extending inwardly in the depth direction from the second flange and offset laterally from the first web section, and a transition web section extending laterally to connect the first and second web sections;

a plurality of horizontal frame members extending laterally between the vertical frame members of the pair of vertical frame members to connect the vertical frame members together;

wherein each said first flange has a series of vertically arranged mounting openings, and each said second flange has a series of vertically arranged mounting openings, and wherein the vertical frame members of the pair of vertical frame members are oriented in an inverted relationship with respect to one another such that (a) the first flange of one of the pair of vertical frame members and the second flange of the other of the pair of vertical frame members are positioned on one face of the pre-assembled internal frame and (b) the second flange of said one of the pair of vertical frame members and the first flange of said other of said pair of vertical frame members are positioned on an opposing face of the pre-assembled internal frame, thus enabling said pre-assembled internal frame to be arranged in an end-to-end junction with another of said pre-assembled internal frame with adjacent said vertical frame members of the pre-assembled internal frames at the end-to-end junction abutting and the first and second flanges of the abutting vertical frame members positioned adjacent one another at the end-to-end junction;

wherein the plurality of horizontal frame members includes at least one intermediate horizontal frame member spaced vertically from the top and bottom of the pre-assembled internal frame, wherein each of the first and second web sections includes a fastener receiving portion, each fastener receiving portion having a fastener receiving opening corresponding to an associated one of the at least one intermediate horizontal frame member and a fastener positioned therein for fastening the associated one of the at least one horizontal frame member to the vertical frame members of the pair of vertical frame members;

wherein said fastener receiving portions are recessed laterally inwardly from the first and second web sections for avoiding interference between adjacent fasteners when said pre-assembled internal frame is arranged in said end-to-end junction with another of said pre-assembled internal frame.

28. A method of installing a modular wall, comprising:

positioning a plurality of pre-assembled internal frames according to claim 27 in a vertical orientation in alignment with one another to form an end-to-end junction between each of the adjacent pairs of the plurality of pre-assembled internal frames;

securing the internal frames to maintain the vertical orientation;

mounting wall panels to opposing faces of the internal frames, wherein each of the wall panels has a plurality of mounting inserts on an inner face thereof at opposing lateral edges thereof and each of the wall panels is mounted by inserting the mounting inserts at one lateral edge thereof into an the series of vertically arranged openings on the first flange of the corresponding internal frame and inserting the mounting inserts at the other lateral edge thereof into the series of vertically arranged openings on the second flange of the corresponding internal frame.

29. The shipping container comprising a plurality of the pre-assembled internal frames claim 27 stacked in a face-to-face relation.

30. The shipping container according to claim 29, wherein the shipping container is devoid of wall panels.

* * * * *